United States Patent [19]

Breslow et al.

[11] 4,053,158

[45] Oct. 11, 1977

[54] SKILL-TYPE BOARD GAME

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 652,430

[22] Filed: Jan. 26, 1976

[51] Int. Cl.[2] ..... A63F 3/00

[52] U.S. Cl. ..... 273/135 R; 273/119 R

[58] Field of Search ..... 273/134 AF, 134 B, 134 C, 273/135 R, 135 AC, 135 C, 138 R, 108, 109, 119 R, 120 R, 115, 125 R

[56] References Cited

U.S. PATENT DOCUMENTS

| | | | |
|---|---|---|---|
| 1,983,044 | 12/1934 | Maynard | 273/125 R |
| 2,177,078 | 10/1939 | Raizen et al. | 273/134 C |
| 2,199,016 | 4/1940 | Watkins | 273/134 B |
| 2,492,462 | 12/1949 | Caesar | 273/115 |
| 3,666,268 | 5/1972 | Candusso | 273/109 |
| 3,787,050 | 1/1974 | Goldfarb | 273/120 R |
| 3,907,299 | 9/1975 | Kristen | 273/134 C |

FOREIGN PATENT DOCUMENTS

| | | | |
|---|---|---|---|
| 686,517 | 1/1940 | Germany | 273/119 R |
| 657,563 | 9/1951 | United Kingdom | 273/134 B |

*Primary Examiner*—William H. Grieb
*Assistant Examiner*—Harry G. Strappello
*Attorney, Agent, or Firm*—Mason, Kolehmainen, Rathburn & Wyss

[57] ABSTRACT

A skill-type game device is provided for use in combination with a board game or the like to introduce a significant element of manual skill into a game which may otherwise be mostly a chance game. The skill device includes an undulated track along which a roller, such as a ball, can be propelled by a player. The track has a number of alternate hills and valleys along the length thereof and each of the valleys is awarded a different score, the player being awarded the score of the valley in which his ball comes to rest. The board game is provided for play by a plurality of players and in which the undulated track is mounted on a supporting game board. A stack of play directing cards is provided from which each player, in his turn, selects the top card. The card directs the player whether to use the skill device or take some other action such as collecting money from a bank or selecting other reward cards provided in the game. In the specific game described, the objective is to obtain movie award certificates designated as awards for performance in various areas of the movie industry.

3 Claims, 4 Drawing Figures

SKILL-TYPE BOARD GAME

BACKGROUND OF THE INVENTION

The present invention relates to manually operable skill devices and more particularly relates to a board-type game using such a device to introduce an element of skill into a game which otherwise might be largely a game of chance.

SUMMARY OF THE INVENTION

The present invention provides a skill game device having a generally horizontal undulated surface defining hills and valleys which are tracked by a rolling member, such as a ball. The player manually launches the ball and a different score value is awarded to the player, depending on the valley in which the ball comes to rest. The undulated surface comprises a pair of identical parallel rails which also serve as lateral guides for the ball during tracking. The ball can be launched onto the surface or track by a manually operable ramp pivotally movable between a static level position for retaining the ball and an inclined position for delivering the ball to the undulated track by gravity roll.

A game also is provided for play by a plurality of players and incorporating the above-mentioned skill device. In the game each player draws a play card from a stack and the card instructs his as to his move. One such move can involve his use of the skill device to receive a score in the form of a numerical value and/or in the form of an object used in play of the game. The scores and objects are accumulated as needed for trading for one or more awards. The player with the most awards at the end of the game is declared the winner.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

DESCRIPTION OF THE PREFERRED EMBODIMENT

Figures 1, 2, 3, 4:
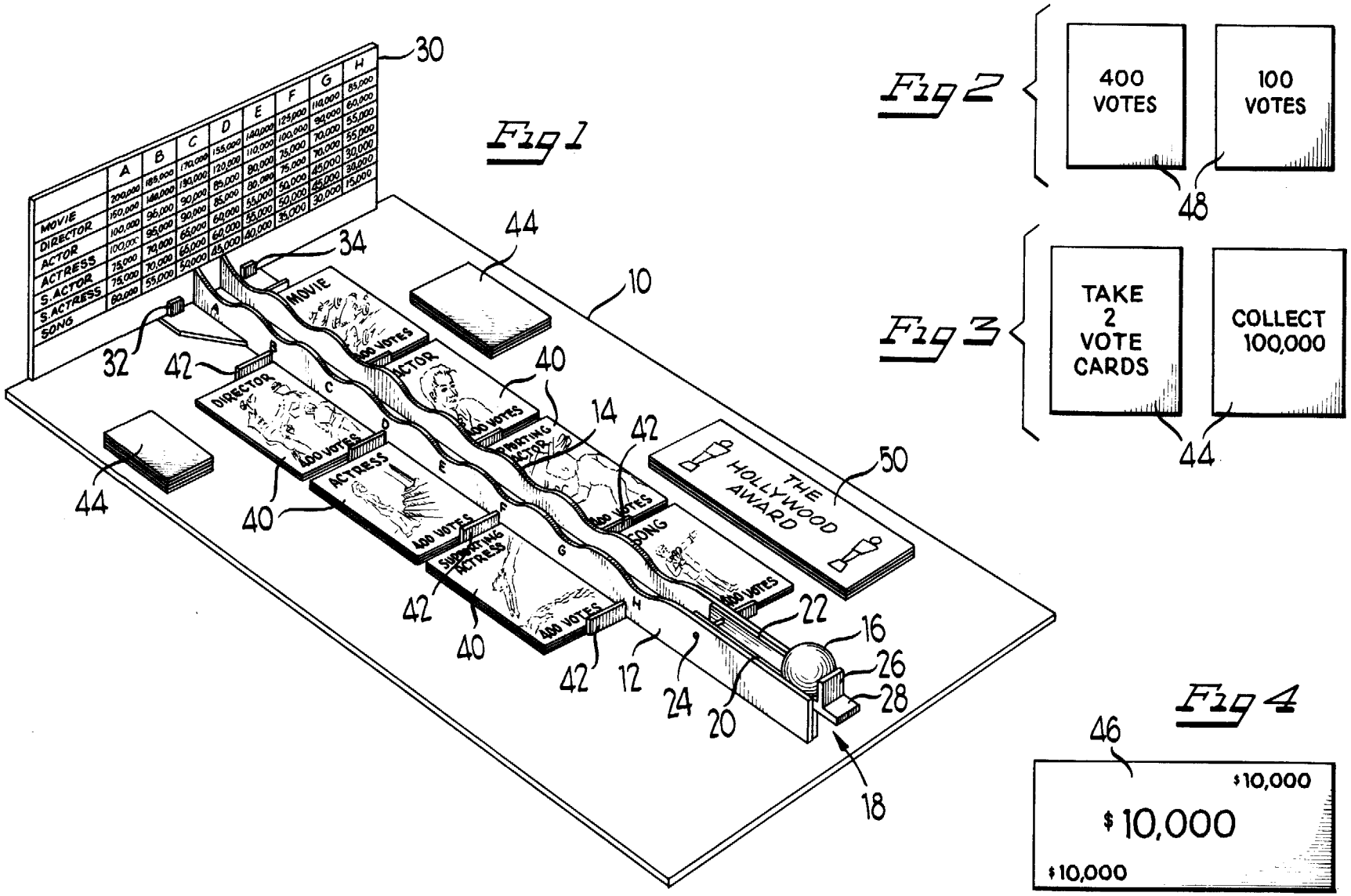
FIG. 1 is a perspective view of a board game embodying a skill device according to the present invention.
FIG. 2 is an enlarged illustration of representative "vote" cards intended for use in the play of the game illustrated in FIG. 1.
FIG. 3 is an enlarged illustration of representative "play directing" cards intended for use in the play of the game illustrated in FIG. 1.
FIG. 4 illustrates the face of a piece of play money intended for use in the game of FIG. 1.

Referring to FIG. 1, the skill device of the present invention is mounted on a base platform in the form of a game board 10. The skill device includes a generally horizontally disposed undulated track comprised of a pair of identical side rails 12 and 14 for supporting and guiding a roller means in the form of a ball 16 as the ball 16 traverses the length of the track. The undulations on the top of the side rails 12 and 14 run generally parallel to each other defining valleys A through H, in any of which the ball 16 may come to rest during its travel.

A bifurcated ball propelling or launching device is provided in the form of a ramp, generally designated 18, formed of a pair of parallel rails 20 and 22. Ramp 18 is pivotally mounted at 24 between rails 12 and 14 for movement between a generally level static position shown in FIG. 1 and an inclined launching position. The bifurcated device also includes a ball retaining flange 26 for retaining a ball against movement backward from the rails 12 and 14 while in static position and has a lift handle 28 which, when raised, pivots the ramp 18 about the pivot point 24 to its inclined launch position for propelling the ball 16 onto and along the rails 12 and 14.

A stop member in the form of an upstanding rigid placard 30 prevents discharge of ball 16 from the distal end of rails 12 and 14. Upon striking placard 30 ball 16 may rebound back over the rails 12 and 14 and eventually will come to rest in one of the valleys A through H. The placard 30 is removably received by clips 32 and 34, on the front and back thereof, in its upright position and has imprinted thereon a chart of score values indicating various scores for the various valleys A through H to be used in the play of a game. Generally, in using a skill device each player takes a turn and a better score value is awarded for causing the ball 16 to come to rest in the valleys further from the launching ramp 18 since it has been found generally more difficult to do this than bring the ball to rest in a nearer valley such as valley H.

In the specific game as illustrated and in one method of play thereof, category cards 40 are provided on board 10. A stack of such cards is positioned laterally along side of each of the valleys B through H between opposing separator ribs 42 which upstand from board 10. The stacks of category cards 40 alternate on either side of the pair of rails 12 and 14 to provide for the use of larger cards 40 on a more compact game board 10.

In order to direct the play of the game, play cards 44 (FIGS. 1 and 3) are provided face down in a stack. Each player, when it is his turn, selects a play card 44 from the stack and the indicating means on the card instructs the player as to what he should do. The play card may direct him to collect an amount from the bank, or to pay an amount back in money, or to select additional play cards or other cards. Another option that can be dictated by the play cards is to have the player launch ball 16 along the rails 12 and 14. When the ball comes to rest in one of the valleys A–H, the player is eligible to obtain a category card from the corresponding stack.

The category cards in each stack are random and cover such categories normally associated with awards in the movie industry, samples of which are identified in FIG. 1. The player then shoots or launches the ball 16 once again along the track to determine the price he will have to pay in play money 46 for purchase of the category card. For this purpose a supply of play money 46 may be distributed to each player at the beginning of the game, or the rules may be such that the player is solely dependent on drawing proper play cards for his supply of play money.

A chart on placard 30 has a plurality of columns identified across the top thereof, one of each valley A through H and, at the left, has a list of various available awards. If the player has sufficient money indicated by cross-reference of the valley letter with the category on the chart he may pay the bank and receive his category card.

Also within the stack of play-directing cards 44 are a number of cards directing the players to vote for an award. Each time one of these cards is drawn, the players with identical category cards vote against each other for the award. Each category card is marked with the minimum number of votes required to obtain an award and votes indicated on vote cards 48 owned by a particular player are applied to the category card of that player and the player of the highest total above the minimum receives the award. For this purpose, a stack of distributable award certificates is shown at 50 (FIG. 1). The game is terminated when all of the award certificates 50 have been distributed to the players of the game and the player with the most award certificates is determined the winner.

It will be apparent from the foregoing that the present invention provides not only a new and useful skill device for determining score values or other rewards to be received by players in a game, but also provides a new and useful amusement and entertainment game, as well as a method for playing that game. Modifications in the invention will be apparent to those having ordinary skill in the art.

We claim:

1. A game of skill and chance comprising a game board for play by a plurality of players, a set of master play directing cards each having indicating means instructing a player as to a playing move to be made by the player, a skill device mounted on said board manually operable by a player to obtain a skill oriented score upon receipt of instructions to the player by a play directing card to operate the skill device, said skill device comprising an undulated surface having a plurality of valleys spaced therealong representing different score values, a plurality of different sets of category cards positionable on said game board in structural alignment with said valleys of said undulated surface to define different award categories therefor, and a playing piece manually launchable along said surface and capable of coming to rest in any one of said valleys.

2. The device of claim 1 including a set of vote cards for bidding by players of the game for said award cards.

3. The device of claim 1 including a score placard forming a backstop for said playing piece at one end of said undulated surface.

* * * * *